US008016135B2

(12) United States Patent
Price et al.

(10) Patent No.: US 8,016,135 B2
(45) Date of Patent: Sep. 13, 2011

(54) PRODUCT DISPLAY SUPPORT SYSTEMS AND METHODS

(75) Inventors: Jerry Price, Mount Vernon, WA (US); Paul Wells, Mount Vernon, WA (US)

(73) Assignee: Mobile Merchandisers, Inc., Mount Vernon, WA (US)

( * ) Notice: Subject to any disclaimer, the term of this patent is extended or adjusted under 35 U.S.C. 154(b) by 0 days.

(21) Appl. No.: 12/703,038

(22) Filed: Feb. 9, 2010

(65) Prior Publication Data

US 2010/0187386 A1 Jul. 29, 2010

Related U.S. Application Data

(63) Continuation of application No. 12/154,193, filed on May 20, 2008, now abandoned, which is a continuation of application No. 11/405,339, filed on Apr. 17, 2006, now Pat. No. 7,374,052, which is a continuation-in-part of application No. 10/766,075, filed on Jan. 28, 2004, now Pat. No. 7,131,546.

(51) Int. Cl.
*A47F 5/00* (2006.01)

(52) U.S. Cl. ..... 211/86.01; 211/103; 211/106; 211/DIG. 1

(58) Field of Classification Search ..... 211/86.01, 211/103, 106, 118, DIG. 1, 87.01, 113, 117, 211/119.004, 189, 175; 248/683, 206.5, 248/309.4; 220/483; 24/303; 206/818, 350
See application file for complete search history.

(56) References Cited

U.S. PATENT DOCUMENTS

| | | | |
|---|---|---|---|
| 1,009,679 | A | 11/1911 | McFadden |
| 2,156,184 | A | 4/1939 | Koski |
| 2,977,082 | A | 3/1961 | Harris |
| 3,017,036 | A | 1/1962 | Albert et al. |
| 3,221,893 | A | 12/1965 | Glaberson et al. |
| 4,138,019 | A | 2/1979 | Smith |
| 4,586,616 | A | 5/1986 | Cooper et al. |
| 4,609,173 | A | 9/1986 | Belokin |
| 5,037,051 | A | 8/1991 | Moriello |
| 5,078,281 | A | 1/1992 | Johnson |
| 5,333,744 | A | 8/1994 | LoCicero et al. |
| 5,460,305 | A | 10/1995 | Ahearn |
| 5,477,967 | A | 12/1995 | Voorhees et al. |
| 5,484,932 | A | 1/1996 | Marhold |

(Continued)

OTHER PUBLICATIONS

USPTO, Office Action U.S. Appl. No. 12/154,193 dated May 11, 2009, 13 pages.

(Continued)

*Primary Examiner* — Jennifer E. Novosad
(74) *Attorney, Agent, or Firm* — Michael R. Schacht; Schacht Law Office, Inc.

(57) ABSTRACT

A display support system for supporting product for retail display from an appliance defining a magnetically attractable display surface, a door surface, and a magnetically attractable upper surface and comprising a door arranged to allow access to an interior of the appliance through the door surface. The display support system comprises an accessory, a structure comprising a front portion and a rear portion, and a magnetic portion. The accessory is adapted to support the product for retail display. The front portion is adapted to support the accessory such that the accessory extends from the display surface of the appliance. The rear portion rigidly is connected to the front portion and extends along and engages the upper surface of the appliance to bear downward loads on the front portion. The magnetic portion magnetically secures the structure relative to the appliance and inhibits movement of the front portion away from the display surface.

19 Claims, 14 Drawing Sheets

U.S. PATENT DOCUMENTS

| | | | |
|---|---|---|---|
| 5,526,941 | A | 6/1996 | Ford |
| 5,547,088 | A | 8/1996 | Belokin et al. |
| 5,611,442 | A | 3/1997 | Howard |
| 5,639,060 | A | 6/1997 | Spoonts et al. |
| 5,695,073 | A | 12/1997 | Klein et al. |
| 5,788,093 | A | 8/1998 | Krut |
| 5,894,940 | A | 4/1999 | Gusdorf et al. |
| 5,931,316 | A | 8/1999 | Carpinelli |
| 5,941,623 | A | 8/1999 | Linehan |
| 5,979,675 | A | 11/1999 | Moriarty |
| 6,089,387 | A | 7/2000 | Varfolomeeva |
| 6,152,311 | A | 11/2000 | German |
| 6,179,136 | B1 | 1/2001 | Kluge et al. |
| 6,216,888 | B1 | 4/2001 | Chien |
| 6,318,569 | B1 | 11/2001 | Rothing |
| 6,352,229 | B1 | 3/2002 | Adams |
| 6,540,093 | B1 | 4/2003 | Shumway |
| 6,588,606 | B2 | 7/2003 | Miller, Jr. et al. |
| 6,712,229 | B2 | 3/2004 | Fritsche et al. |
| 6,726,034 | B2 | 4/2004 | Holbrook et al. |
| 6,932,225 | B2 | 8/2005 | Rowe |
| 6,951,290 | B2 | 10/2005 | Speed |
| 7,131,546 | B1 | 11/2006 | Price et al. |
| 7,261,214 | B2 | 8/2007 | Wagner et al. |
| 7,374,052 | B2 * | 5/2008 | Price et al. ..... 211/86.01 |
| 7,401,705 | B2 | 7/2008 | Craft |
| 7,506,772 | B2 | 3/2009 | Chen |
| 2001/0050262 | A1 | 12/2001 | LaBruna, Jr. et al. |
| 2002/0030027 | A1 | 3/2002 | Welsch |
| 2003/0038100 | A1 | 2/2003 | Liu |
| 2004/0007549 | A1 | 1/2004 | Klein et al. |
| 2004/0094494 | A1 | 5/2004 | Klein et al. |
| 2004/0118791 | A1 | 6/2004 | Rimback et al. |
| 2007/0221595 | A1 | 9/2007 | Chen |

OTHER PUBLICATIONS

Schacht Law Office, Response U.S. Appl. No. 12/154,193 dated Aug. 11, 2009, 10 pages.

USPTO, Office Action U.S. Appl. No. 12/154,193 dated Nov. 9, 2009, 7 pages.

USPTO, Office Action U.S. Appl. No. 12/154,193 dated May 18, 2010, 2 pages.

* cited by examiner 122
172
138
190
194
182
130
140
170
120
124
180
184
174
134
144
154
132
192
196
126a
128
136
126b
142
150
160
162
156
152

PRODUCT DISPLAY SUPPORT SYSTEMS AND METHODS

RELATED APPLICATIONS

This is a continuation of U.S. patent application Ser. No. 12/154,193, filed May 20, 2008, which is a continuation of U.S. patent application Ser. No. 11/405,339 filed Apr. 17, 2006, now U.S. Pat. No. 7,374,052 issued May 20, 2008, which is continuation-in-part of U.S. patent application Ser. No. 10/766,075 filed on Jan. 28, 2004, now U.S. Pat. No. 7,131,546 issued Nov. 7, 2006. The contents of all related applications are incorporated herein by reference.

TECHNICAL FIELD

The present invention relates to systems and methods for displaying products in a retail setting and, more specifically, to display support systems and methods that support products on metal product display cases.

BACKGROUND

The present invention generally relates to display rack systems for use in retail sales environments. The following discussion describes the present invention in the context of such display shelf on which product is arranged for display. The principles of the present invention may, however, be more broadly applied to other support structures for types of product that are not typically displayed on shelves. The scope of the present invention should thus be determined by the claims appended hereto and not the following detailed discussion.

Product display support systems, also sometimes referred to as point-of-purchase displays, are manufacture and sold in a large number of configurations. Some point-of-purchase displays are free-standing units, while others are adapted to be placed on or supported by a structural member such as a countertop. In a retail environment, product space is at a premium, and at many retail stores point-of-purchase displays are placed at all feasible locations.

Retail stores often employ metal display cases for the display of product. For example, refrigerated display cases are often used to display frozen products and products requiring refrigeration. Refrigerated display cases typically comprise a metal housing and a glass door. The metal housing defines a front or door surface, a rear surface, left and right side surfaces, a top surface, and a bottom surface. The door surface defines a door opening through which product is accessed, and the glass door conventionally covers the door opening. Typically, the product is visible through the glass door.

Metal display cases may be arranged side by side in a row facing an aisle or may be placed at the end of a row. In these situations, the at least one of the metal left and right side surfaces may be exposed to consumers. Because space is at such a premium in the retail environment, retailers would like to make use of the exposed side surfaces of a metal display case. In the following discussion, either one of the side surfaces of a metal display case that is exposed to consumers will be referred to as a display surface.

To make use of a display surface, a standalone display rack may be placed on the floor adjacent to the display surface. However, a standalone display rack may occupy too much floor space for a given environment and/or may not cover the entire display surface. Shelf components may be screwed directly to the display surface or another part of the display case. However, many display cases are insulated and/or contain electrical components, and piercing the surface of the case with a screw is undesirable.

The need thus exists for product display support systems and methods that allow display surfaces on metal display cases to be utilized in a manner that is cost effective and flexible.

RELATED ART

The following U.S. Patents were uncovered as part of a professional patentability search conducted on behalf of the Applicant.

U.S. Pat. No. 5,941,623 to Linehan discloses a storage system for refrigerators in which two sheets are arranged on each side of the refrigerator. A strap extends over the top of the refrigerator between the two side sheets. The side panels support each other through the strap like saddle bags. The device disclosed in the Lineham patent relies on friction and the weight of the opposite side sheets to support the device in a desired position on the refrigerator.

U.S. Pat. No. 6,318,569 to Rothing discloses a magnetic shelf that is attached to the side of a refrigerator. The magnets simply engage the vertical side of the refrigerator and thus would not carry significant weight.

U.S. Pat. No. 6,588,606 to Miller, Jr. et al. discloses the use of suction-type attachment assemblies to support a display rack from a vertical surface.

The remaining patents simply relate to magnetic attachment systems and are not specifically designed for displaying or suspending items from a metal display case.

U.S. Patent Application No. US 2003/0031800 discloses a magnet equipped rack for tools and the like.

U.S. Pat. No. 6,352,229 to Adams discloses a clip assembly having a magnetic base and a flexible clip.

U.S. Pat. No. 5,460,305 to Aheam discloses a tool pouch employing magnets to attach the tool pouch to a metal structure such as a vehicle.

U.S. Pat. No. 5,078,281 to Johnson discloses a swivel bracket for a mechanic's work tray. This swivel bracket has a magnetic attachment for securing the bracket to a metal surface.

U.S. Pat. No. 4,609,173 to Belokin discloses a magnetically attachable towel hanger. The magnets are arranged to engage a vertical surface.

U.S. Pat. No. 4,586,616 to Cooper et al. discloses a utensil mounting bar having a magnet backing. The utensil bar may be adapted to support a towel rack, tool rack, or the like from vertical metal surface.

U.S. Pat. No. 3,017,036 to Albert et al. discloses a magnetic support for allowing towel racks, hooks, and the like to be attached to a vertical metal surface.

U.S. Pat. No. 2,977,082 to Harris discloses a magnetic support having a bolt assembly formed therein. The bolt assembly allows the metal support to be used with a variety of different items. FIG. 6 is of interest in that it engages a horizontal surface. In this embodiment, the support is attached to a paper holder for holding a sheet of paper.

SUMMARY

The present invention may be embodied as a display support system for supporting product for retail display from an appliance defining a magnetically attractable display surface, a door surface, and a magnetically attractable upper surface and comprising a door arranged to allow access to an interior of the appliance through the door surface. The display support system comprises an accessory, a structure comprising a front portion and a rear portion, and a magnetic portion. The accessory is adapted to support the product for retail display. The front portion is adapted to support the accessory such that the accessory extends from the display surface of the appliance. The rear portion rigidly is connected to the front portion and extends along and engages the upper surface of the appliance to bear downward loads on the front portion. The magnetic portion magnetically secures the structure relative to the appliance and inhibits movement of the front portion away from the display surface.

The present invention may also be embodied as a method of supporting product for retail display from an appliance defining a magnetically attractable display surface, a door surface, and a magnetically attractable upper surface and comprising a door arranged to allow access to an interior of the appliance through the door surface. The method comprises the following steps. A structure defining a front portion and a rear portion is provided. The rear portion extends substantially perpendicularly to the front portion. A magnetic portion is rigidly secured to the structure. The structure is secured relative to the appliance such that the rear portion extends along and engages the upper surface of the appliance such that the upper surface bears downward loads on the front portion and the magnetic portion magnetically secures the structure to a desired location relative to the appliance, thereby inhibiting movement of the front portion away from the display surface. An accessory is provided and supported on the front portion such that the accessory extends from the display surface of the appliance. The product is supported for retail display using the accessory.

The present invention may also be embodied as a display support system for supporting product for retail display from an appliance defining a magnetically attractable display surface, a door surface, and a magnetically attractable upper surface and comprising a door arranged to allow access to an interior of the appliance through the door surface. The display support system comprises an accessory adapted to support the product for retail display, a structure comprising a front portion and a rear portion, and first and second magnetic portions. The front portion is adapted to support the accessory such that the accessory extends from the display surface of the appliance. The rear portion is rigidly connected to the front portion and extends along and engages the upper surface of the appliance to bear downward loads on the front portion. The first magnetic portion is rigidly secured to the rear portion of the structure. The second magnetic portion is rigidly secured to the front portion of the structure. The first and second magnetic portions secure the structure relative to the appliance and thereby inhibit movement of the front portion away from the display surface.

DETAILED DESCRIPTION

Figure 1:
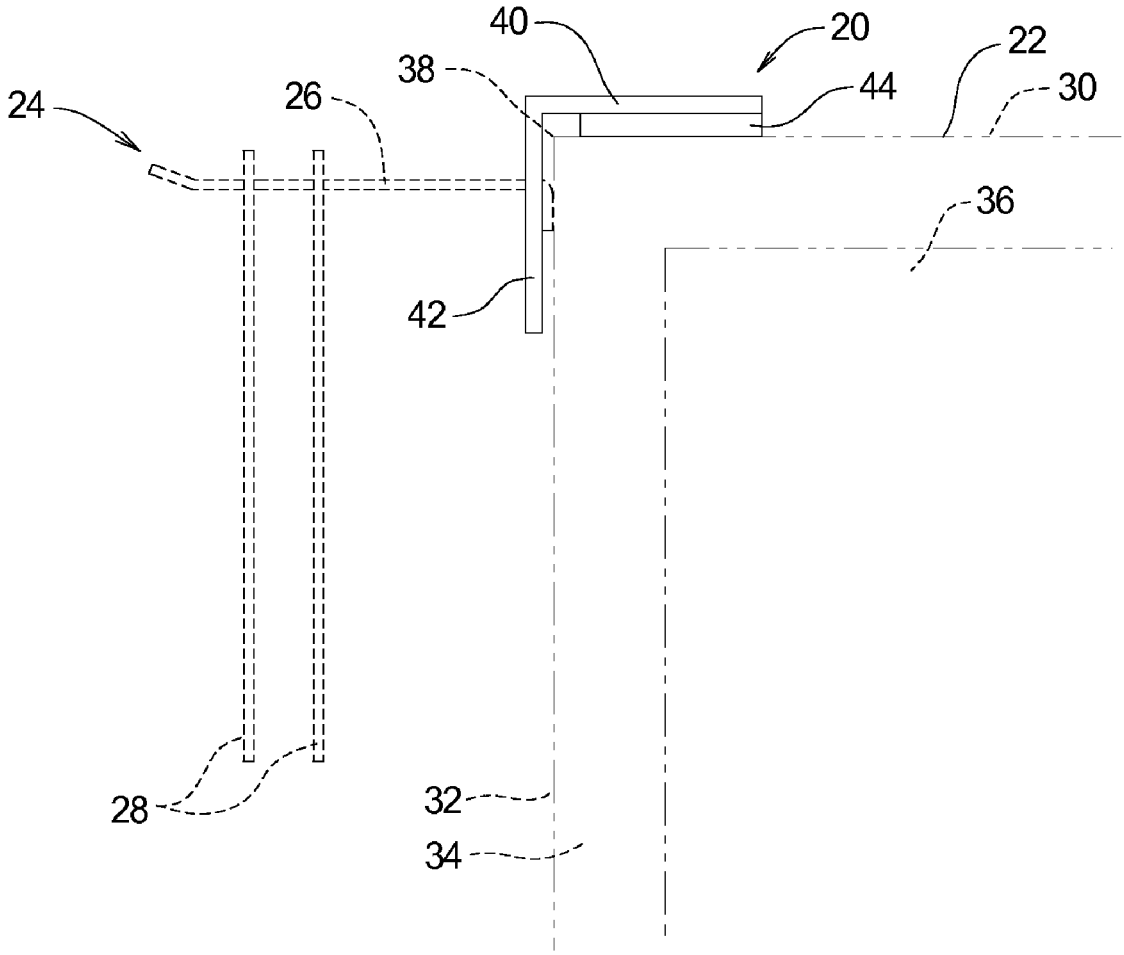
FIG. 1 is a side elevation view of a first embodiment of a display support system embodying, and constructed in accordance with, the principles of the present invention.

Referring now to the drawing, depicted at 20 in FIG. 1 thereof is a display support system constructed in accordance with, and embodying, the principles of the present invention. The display support system 20 is adapted to be supported by a metal structure 22.

The example display support system 20 is depicted supporting an accessory 24 in the form of a wire support 26. The wire support 26 is shown supporting a plurality of products 28. The wire support 26 is not per se part of the present invention, may be conventional, and will be described herein only to the extent necessary for a complete understanding of the present invention. The products 28 are illustrated as examples only, and other products with different packaging may be supported by the system 20.

The metal structure 22 is also not per se part of the present invention and will be described briefly herein to provide a complete understanding of the present invention. The metal structure 22 defines a top surface 30 and a display surface 32. The example metal structure 22 thus further defines a door surface 34 and comprises a glass door 36 through which product may be viewed and accessed. The metal structure 22 is generally in the form of a box, and the top, display, and door surfaces 30, 32, and 34 form three adjacent sides of the box. An upper edge 38 is formed at the juncture of the top surface 30 and display surface 32.

The display support system 20 comprises a rear portion 40, a front portion 42, and a magnetic portion 44. The rear portion 40 is adapted to rest on the top surface 30 of the metal structure 22 adjacent to the upper edge 38. The rear portion 40 is rigidly connected to the magnetic portion 44. The magnetic portion 44 magnetically engages the top surface 30 of the metal structure 22 as shown in FIG. 1. In addition, the front portion 42 is rigidly connected to the rear portion 40 such that, when the magnetic portion 44 engages the top surface 30, the front portion 42 extends along at least a portion of the display surface 32.

Figure 2:
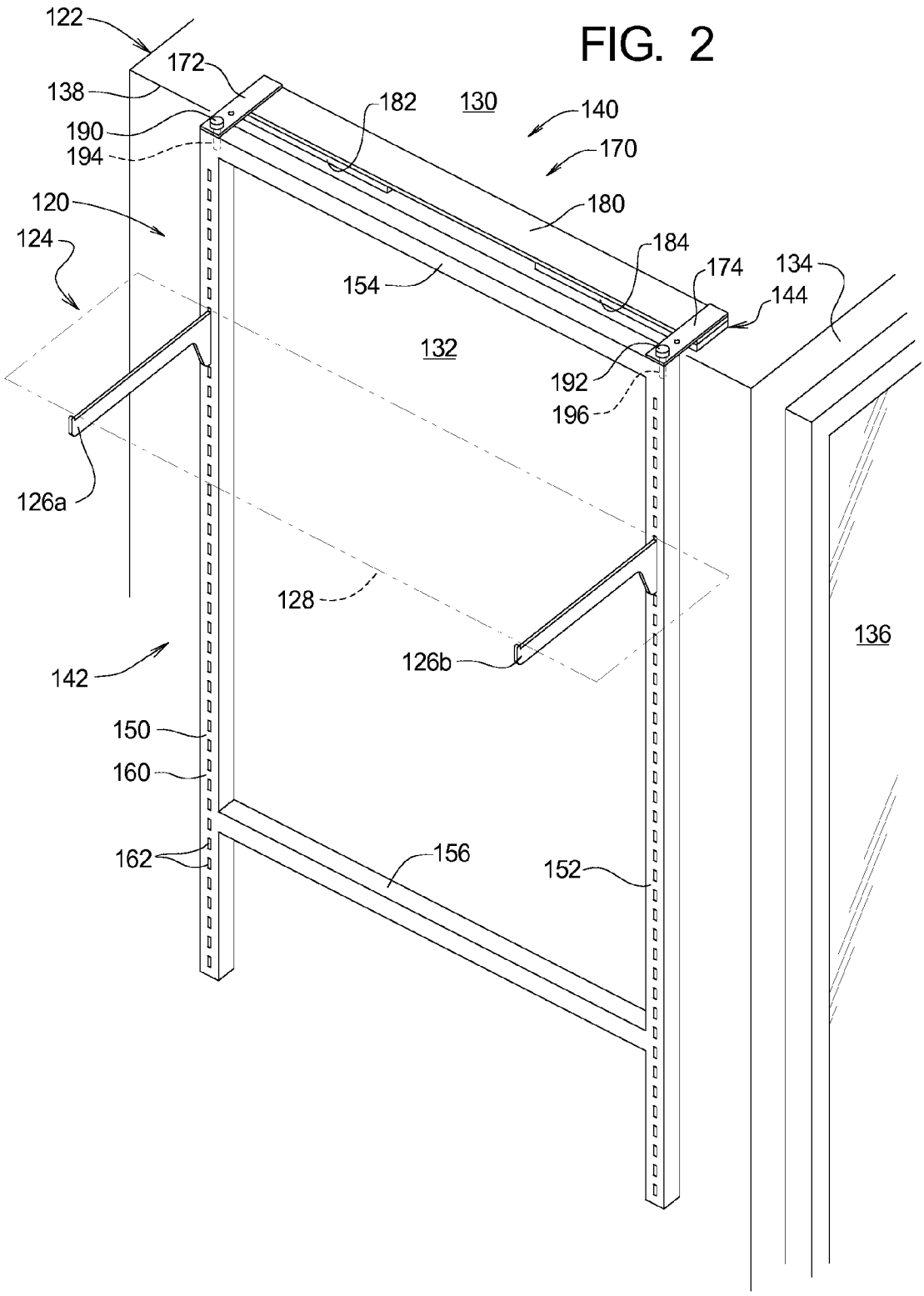
FIG. 2 is a perspective view of a second embodiment of a display support system embodying, and constructed in accordance with, the principles of the present invention.

In use, at least part of the front portion 42 is arranged below the rear portion 40; typically, most of the front portion 42 is arranged below the rear portion 40 as shown in FIGS. 1 and 2. The center of gravity of the support system 20, including any accessories 24 and products 28 supported thereby, is thus typically arranged below the top surface 30 along the display surface 32.

Under static conditions, the weight of the accessory 24 and any products 28 supported thereby places a downward load on the front portion 42 of the display support system 20. Because the front portion 42 is rigidly connected to the rear portion 40, the rear portion 40 in turn transfers to the top surface 30 these downward loads on the front portion 42.

Outward lateral loads on the front portion 42 away from the display surface 32 may be created through various mechanisms. For example, lateral loads on the front portion 42 may be created by accidental jostling of the front portion 42 or any accessories 24, hangers 26, or products 28. Such outward lateral loads tend to be momentary and relatively light in comparison to the downward loads.

Friction between the top surface 30 and the rear portion 40 of the display support system 20 will, to some degree, resist displacement of the system 20 due to outward lateral loads on the front portion 42 thereof. However, the magnetic engagement between the magnetic member 44 and the top surface 30 of the metal structure 22 significantly enhances the resistance to displacement of the system 20 caused by outward lateral loads on the front portion 42.

The magnetic engagement between the magnetic portion 44 of the display support system 20 and the top surface 30 of the metal structure 22 thus resists or prevents inadvertent displacement of the display support system 20 relative to the metal structure 22 under typical outward lateral loads on the front portion 42 of the display support system 20. However, the display support system 20 does not require modification of the metal structure 22 by, for example, the formation of screw holes in the top surface 30 or display surface 32.

To remove the display support system 20, the user simply applies deliberate manual force on the front portion 42 of the system 20 to disengage the magnetic portion 44 from the top surface 30. The entire display support system 20 can then easily be removed from or moved on the metal structure 22.

With the foregoing general understanding of the construction and use of the invention as embodied in the example display support system 20, a second embodiment of the present invention will now be described.

Referring now to FIGS. 2-7, depicted therein is a second embodiment of a display support system 120 of the present invention. In the following discussion, elements of the display support system 120 that are similar to those of the display support system 20 described above will be identified by the same or similar reference characters increased by 100.

The example display support system 120 is depicted supporting accessories 124 in the form of first and second brackets 126a and 126b. The first and second brackets 126 are in turn shown supporting a shelf 128. An item to be displayed may be placed on the shelf 128. The brackets 126 and shelf 128 are or may be conventional and will be described herein only to the extent necessary for a complete understanding of the present invention.

The example metal structure 122 defines a top surface 130 and a display surface 132. The example metal structure 122 is a refrigerated display case and thus further defines a door surface 134 and comprises a glass door 136 through which product may be viewed and accessed. The metal structure 122 is generally in the form of a box, and the top, display, and door surfaces 130, 132, and 134 form three adjacent sides of the box. An upper edge 138 is formed at the juncture of the top surface 130 and display surface 132.

The example display support system 120 comprises a rear portion 140, a front portion 142, and a magnetic portion 144. The rear portion 140 is adapted to rest on the top surface 130 of the metal structure 122 adjacent to the upper edge 138. The rear portion 140 further magnetically engages the top surface 130 as will be described in further detail below. The front portion 142 is rigidly connected to the rear portion 140 such that, when the rear portion 140 engages the top surface 130, the front portion 142 extends along at least a portion of the display surface 132.

A display support system constructed in accordance with the principles of the present invention can be made of a variety of materials and take on a number of configurations. In the example display support system 120, the front portion 142 comprises first and second vertical members 150 and 152 and upper and lower lateral members 154 and 156 formed of hollow metal tubes welded together in a generally rectangular configuration. Hollow metal tubes are readily available, lightweight, and durable, but the front portion 142 may be made from other materials such as plastic, wood, or the like.

Figure 3:
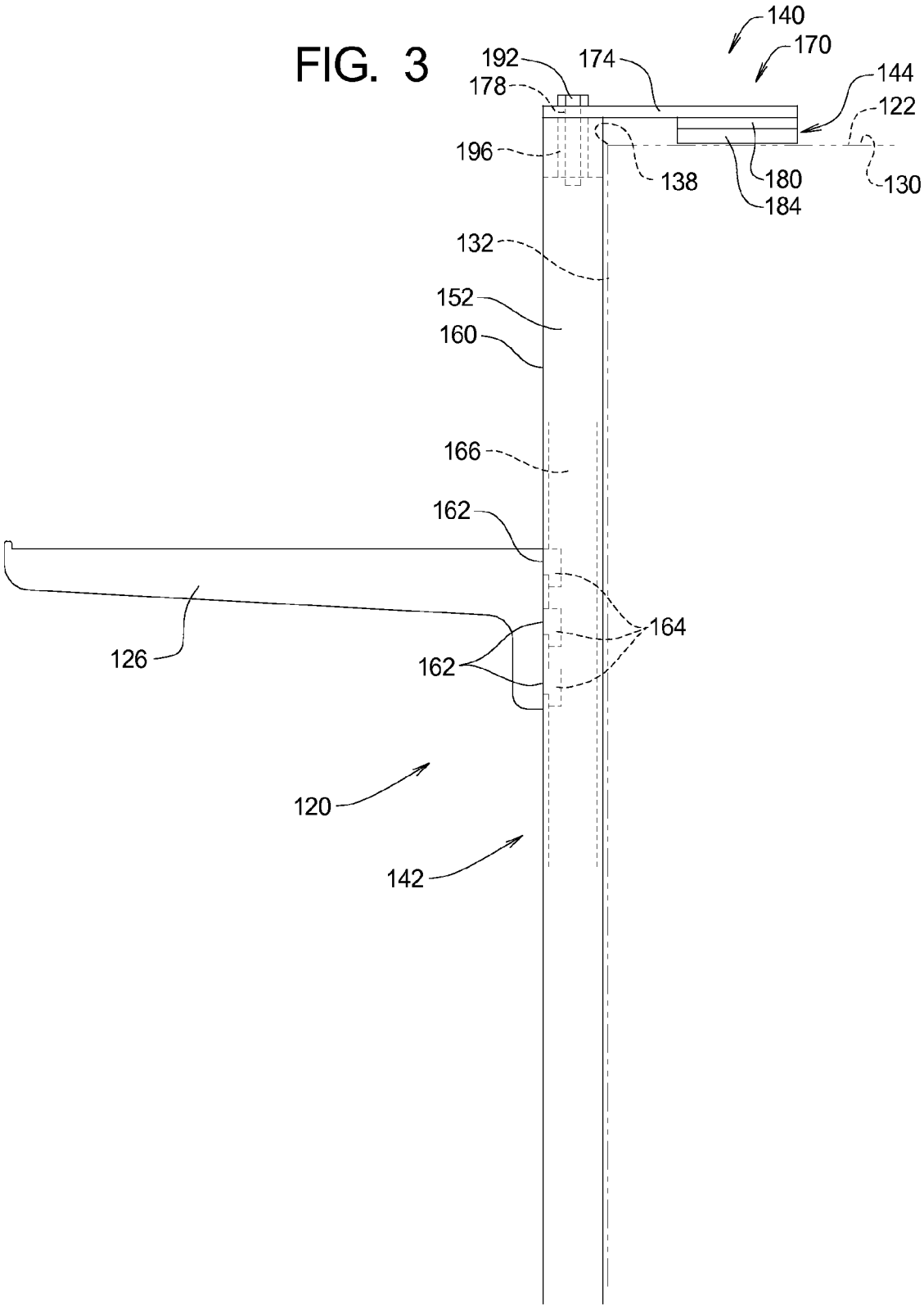
FIG. 3 is a side elevation view of the example display support system depicted in FIG. 2.
Figure 4:
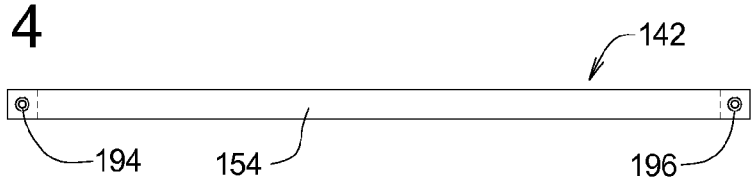
FIG. 4 is a top plan view of a front portion of the display support system depicted in FIG. 2.
Figure 5:
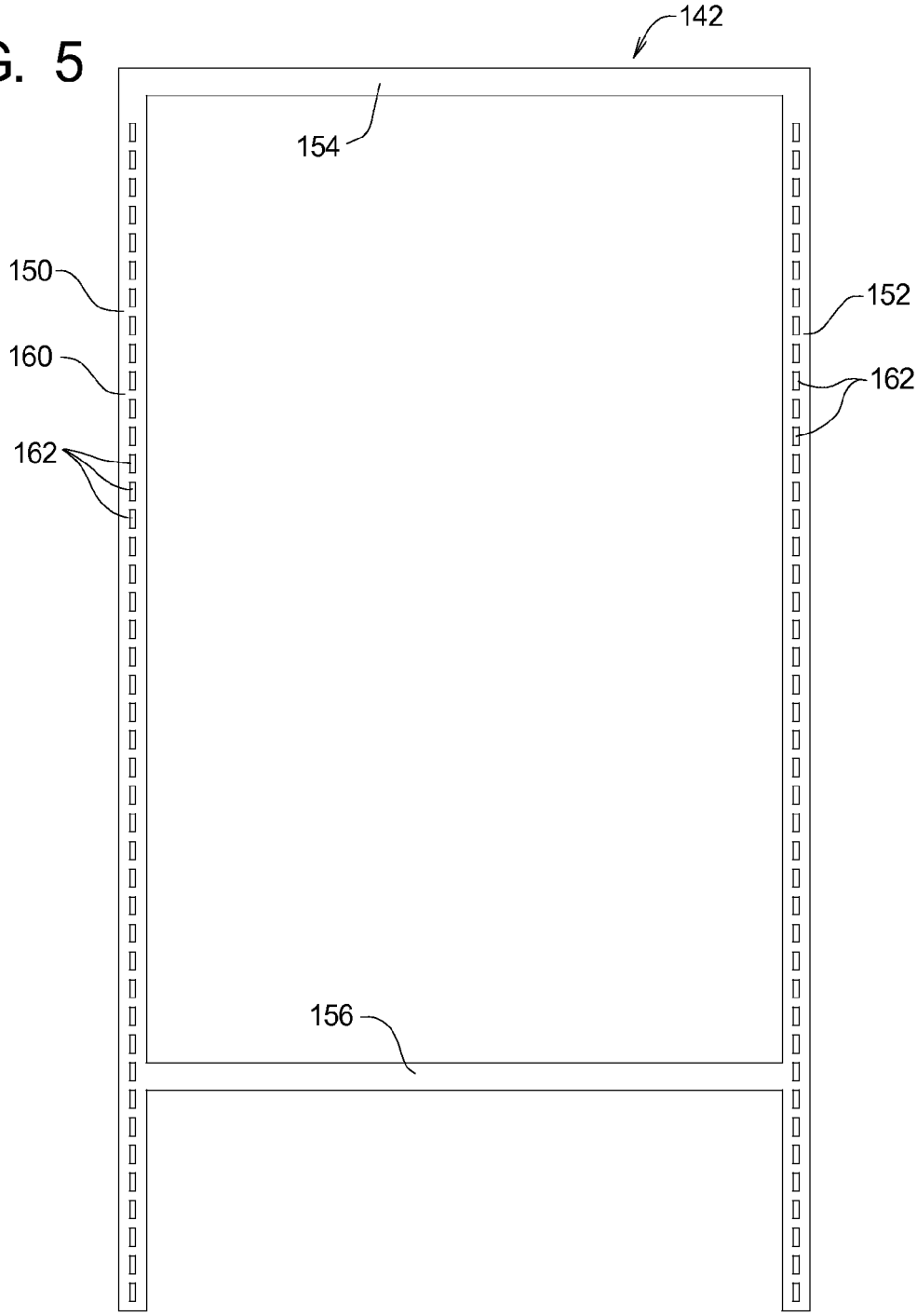
FIG. 5 is a front elevation view of the front portion of the display support system depicted in FIG. 4.
Figure 6:
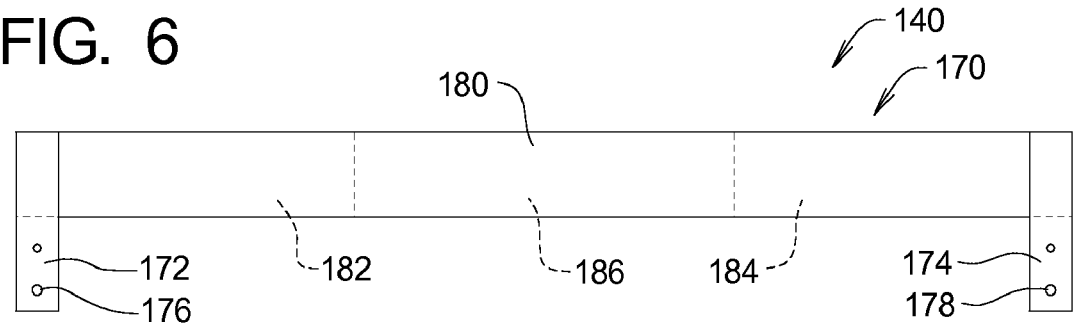
FIG. 6 is a top plan view of a rear portion of the display support system depicted in FIG. 4.
Figure 7:
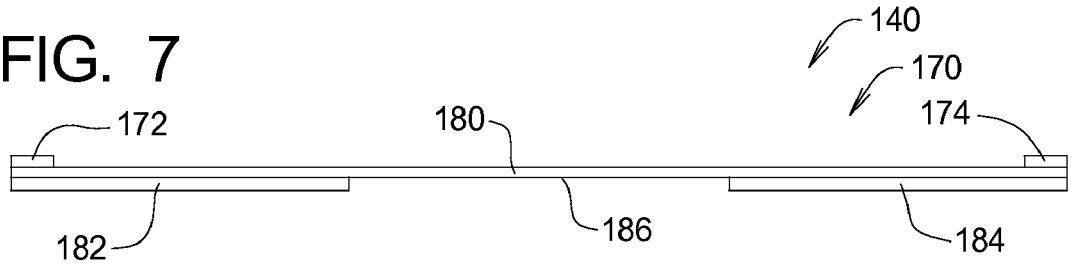
FIG. 7 is a front elevation view of the rear portion of the display support system as depicted in FIG. 6.

As shown in FIG. 3, the hollow metal tubes that form the vertical members 150 and 152 define a front wall 160 in which a series of slots or openings 162 are formed. As is conventional, the openings 162 allow tabs 164 extending from the brackets 126 to extend into interior chambers 166 defined by the vertical members 150 and 152. The tabs 164 engage the front wall 160 to secure the brackets 126 at desired vertical locations along the vertical members 150 and 152. The example brackets 126 are arranged at substantially the same vertical level such that the shelf 128 is substantially level during normal use.

One of ordinary skill in the art will recognize that additional brackets may be used to support additional shelves. Alternatively, accessories 124 other than (or in addition to) brackets may be supported from the front portion 142 of the display support system 120.

For example, as shown in FIG. 1, a wire hanger may be used to support a number of product packages in a back-to-front orientation from a wire hanger. Such wire hangers can be formed to engage the front portion 142 of the display support system 120 using tabs such as the tabs 164 used by the brackets 126.

As another example, clips are often used to grip an upper edge of a packaged product. The clips may be used singly but are often arranged in a vertical row. Such clips may be secured, either singly or in a pre-structured vertical row, to the front portion 142 of the display support system 120. Tabs such as the tabs 164 of the brackets 126 may be used to support the clips or gangs of clips.

The front portion of a display support system of the present invention can take many forms and need not take the form of the example front portion 142 described above. For example, in a simple configuration, the front portion 142 may comprise a single horizontal or vertical member adapted to engage one or more types of desired accessories 124. Alternatively, instead of discrete vertical and horizontal members, the front portion may comprise a sheet of material such as cardboard or plywood adapted to engage one or more types of desired accessories 124. Or instead of a rectangular arrangement of straight vertical and horizontal members, the front portion may be made of curved or angled members in a more fanciful shape.

The rear portion of a display support system of the present invention may also take on a number of different forms depending upon the particular application. As perhaps best shown in FIGS. 6 and 7, the example rear portion 140 comprises a mounting portion 170 comprising first and second spacing members 172 and 174. The example spacing members 172 and 174 are metal sheets in which first and second through holes 176 and 178 are formed.

The mounting portion 170 further comprises a mounting member 180 that extends between the spacing members 172 and 174. The example mounting member 180 is a metal sheet, and the first and second spacing members 172 and 174 are welded to opposite ends of the mounting member 180.

The mounting portion 170 may be made of other materials in other configurations. For example, the mounting portion 170 can be made of plastic or wood and take on other shapes. In addition, instead of discrete spacing and mounting members 172, 174 and 180, the mounting portion 170 can be formed of a single molded or milled member.

In the example display support system 120, the magnetic portion 144 comprises first and second magnetic members 182 and 184 that are secured to a bottom surface 186 of the mounting member 180. The example magnetic members 182 and 184 are in the form flat magnetic sheets having a width dimension that is approximately the same as a width dimension of the mounting member 180. The length of the example magnetic members 182 and 184 is approximately one-third the length of the mounting member 180. In the example rear portion 140, the magnetic members 182 and 184 are glued to opposite ends of the mounting member 180 such that a middle one-third of the bottom surface 186 thereof is not covered by a magnetic member.

The nature, quantity, and configuration of the magnetic members 182 and 184 can take on a number of forms depending upon the precise nature of the rear portion 140 of the display support system 120 and the accessories 124 to be suspended therefrom.

In addition, the magnetic members 182 and 184 can be secured to the mounting member 180 by means other than adhesives. For example a shallow channel or socket may be formed in the mounting member for the magnetic member or members. The magnetic members may also be embedded or laminated in the mounting member.

With the example support system 120 described above, the mounting member 180 of the rear portion 140 indirectly engages the top surface 130 through the magnetic members 182 and 184. In other configurations, the rear portion 140 may directly engage the top surface 130.

Referring again to FIGS. 2 and 3, illustrated therein are first and second bolts 190 and 192. As perhaps best shown in FIG. 4, the bolts 190 and 192 are received in first and second threaded openings 194 and 196 to secure the rear portion 140 to the front portion 142.

The rear portion 140 may be rigidly attached to the front portion 142 using means other than threaded bolts. For example, as in the first embodiment 20 described above, the rear and front portions 140 and 142 may be integrally formed with each other. As another example, the rear and front portions 140 and 142 may be separately formed and the rigidly connected by adhesives, welding, or the like.

Figure 8:
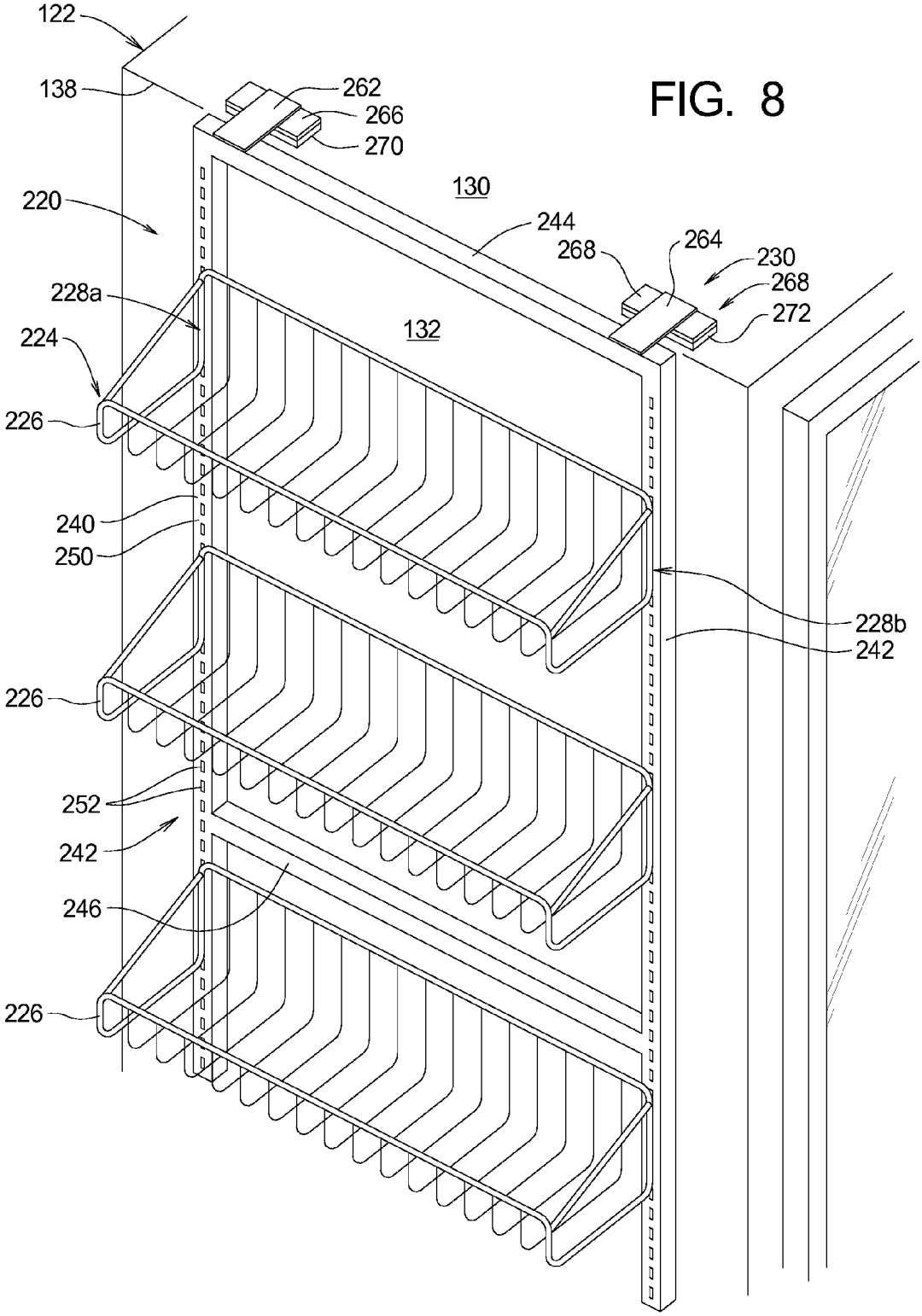
FIG. 8 is a perspective view depicting another example display support system of the present invention.
Figure 9:
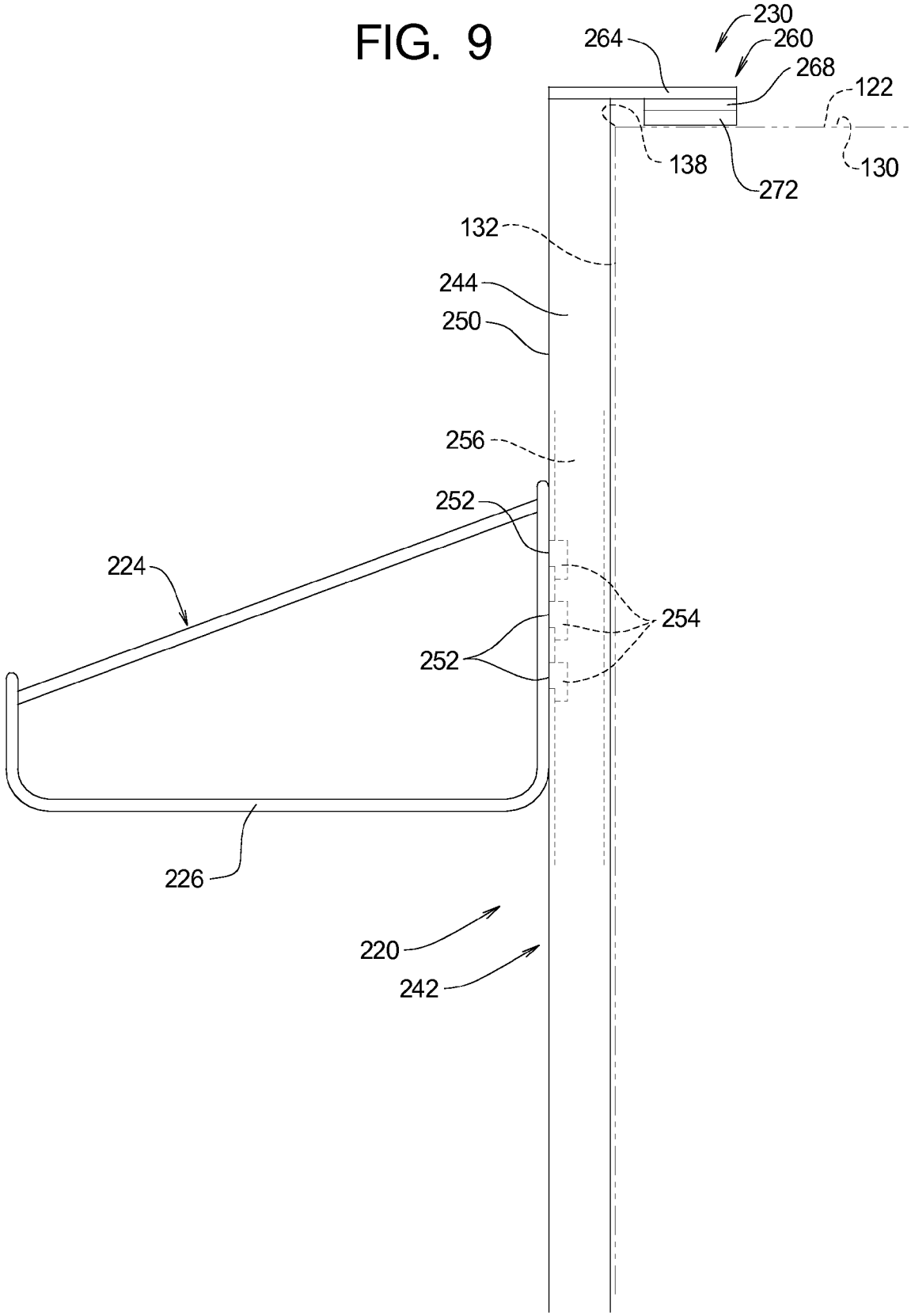
FIG. 9 is a side elevation view of the display system of FIG. 8.

Referring now to FIGS. 8 and 9 of the drawing, depicted therein is a second embodiment of a display support system 220 of the present invention. The display support system 220 is adapted to be supported by the structure 122 described above.

The example display support system 220 is depicted supporting accessories 224 in the form of basket shelves 226. The basket shelves 226 each define engaging portions 228*a* and 228*b*. An item to be displayed may be placed on the shelf 226. The basket shelves 226 are or may be conventional and will be described herein only to the extent necessary for a complete understanding of the present invention.

The example display support system 220 comprises a rear portion 230, a front portion 232, and an upper magnetic portion 234. The rear portion 230 is adapted to rest on the top surface 130 of the metal structure 122 adjacent to the upper edge 138. The upper magnetic portion 234 of the rear portion 230 further magnetically engages the top surface 130 as will be described in further detail below. The front portion 232 is rigidly connected to the rear portion 230 such that, when the rear portion 230 engages the top surface 130, the front portion 232 extends along at least a portion of the display surface 132.

A display support system constructed in accordance with the principles of the present invention can be made of a variety of materials and take on a number of configurations. In the example display support system 220, the front portion 232 comprises first and second vertical members 240 and 242 and upper and lower lateral members 244 and 246 formed of hollow metal tubes welded together in a generally rectangular configuration. Hollow metal tubes are readily available, lightweight, and durable, but the front portion 232 may be made from other materials such as plastic, wood, or the like.

The hollow metal tubes that form the vertical members 240 and 242 define a front wall 250 in which a series of slots or openings 252 are formed. As is conventional, the openings 252 allow tabs 254 extending from the engaging portions 228*a* and 228*b* of the basket shelves 226 to extend into interior chambers 256 defined by the vertical members 240 and 242. The tabs 254 engage the front wall 250 to secure the brackets 226 at desired vertical locations along the vertical members 240 and 242. The example engaging portions 228*a* and 228*b* are arranged at substantially the same vertical level such that the shelf 226 is substantially level during normal use.

One of ordinary skill in the art will recognize that additional brackets may be used to support additional shelves. Alternatively, accessories 224 other than (or in addition to) brackets may be supported from the front portion 232 of the display support system 220. For example, a wire hanger as described above with reference to FIG. 1 may be used to support a number of product packages in a back-to-front orientation from a wire hanger. As another example, clips as generally discussed above may be to grip an upper edge of a packaged product.

The front portion of a display support system of the present invention can take many forms and need not take the form of the example front portion 232 described above. For example, in a simple configuration, the front portion 232 may comprise a single horizontal or vertical member adapted to engage one or more types of desired accessories 224. Alternatively, instead of discrete vertical and horizontal members, the front portion may comprise a sheet of material such as cardboard or plywood adapted to engage one or more types of desired accessories 224. Or instead of a rectangular arrangement of straight vertical and horizontal members, the front portion may be made of curved or angled members in a more fanciful shape.

The rear portion of a display support system of the present invention may also take on a number of different forms depending upon the particular application. As shown in FIGS. 8 and 9, the example rear portion 230 comprises a mounting portion 260 comprising first and second spacing members 262 and 264. The example spacing members 262 and 264 are metal sheets that are welded or otherwise secured to the upper lateral member 244.

The example mounting portion 260 comprises first and second upper mounting plates 266 and 268 to which first and second magnetic members 270 and 272 forming the magnetic portion 234 are secured. The example magnetic members 270 and 272 are in the form flat magnetic sheets having dimensions that are approximately the same as the dimensions of the upper mounting plates 266 and 268. In the example rear portion 230, the magnetic members 270 and 272 are glued to the upper mounting plates 266 and 268, respectively.

The nature, quantity, and configuration of the magnetic members 270 and 272 can take on a number of forms depending upon the precise nature of the rear portion 230 of the display support system 220 and the accessories 224 to be suspended therefrom.

In addition, the magnetic members 270 and 272 can be secured to the upper mounting plates 266 and 268 by means other than adhesives. For example a shallow channel or socket may be formed in the mounting plates for the magnetic member or members. The magnetic members may also be embedded in or laminated to the mounting plates.

Figure 10:
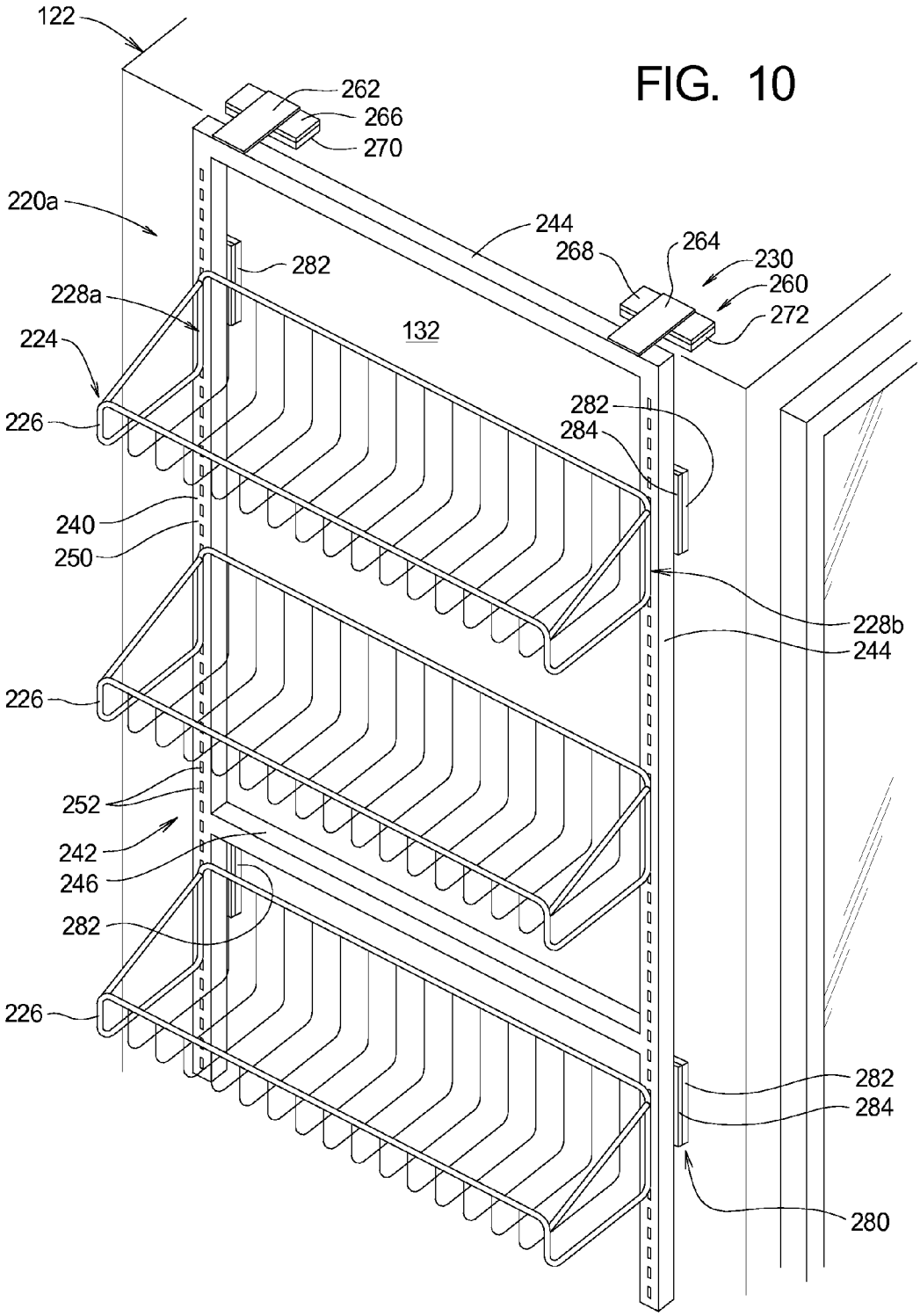
FIG. 10 is a perspective view depicting another example display support system of the present invention.
Figure 11:
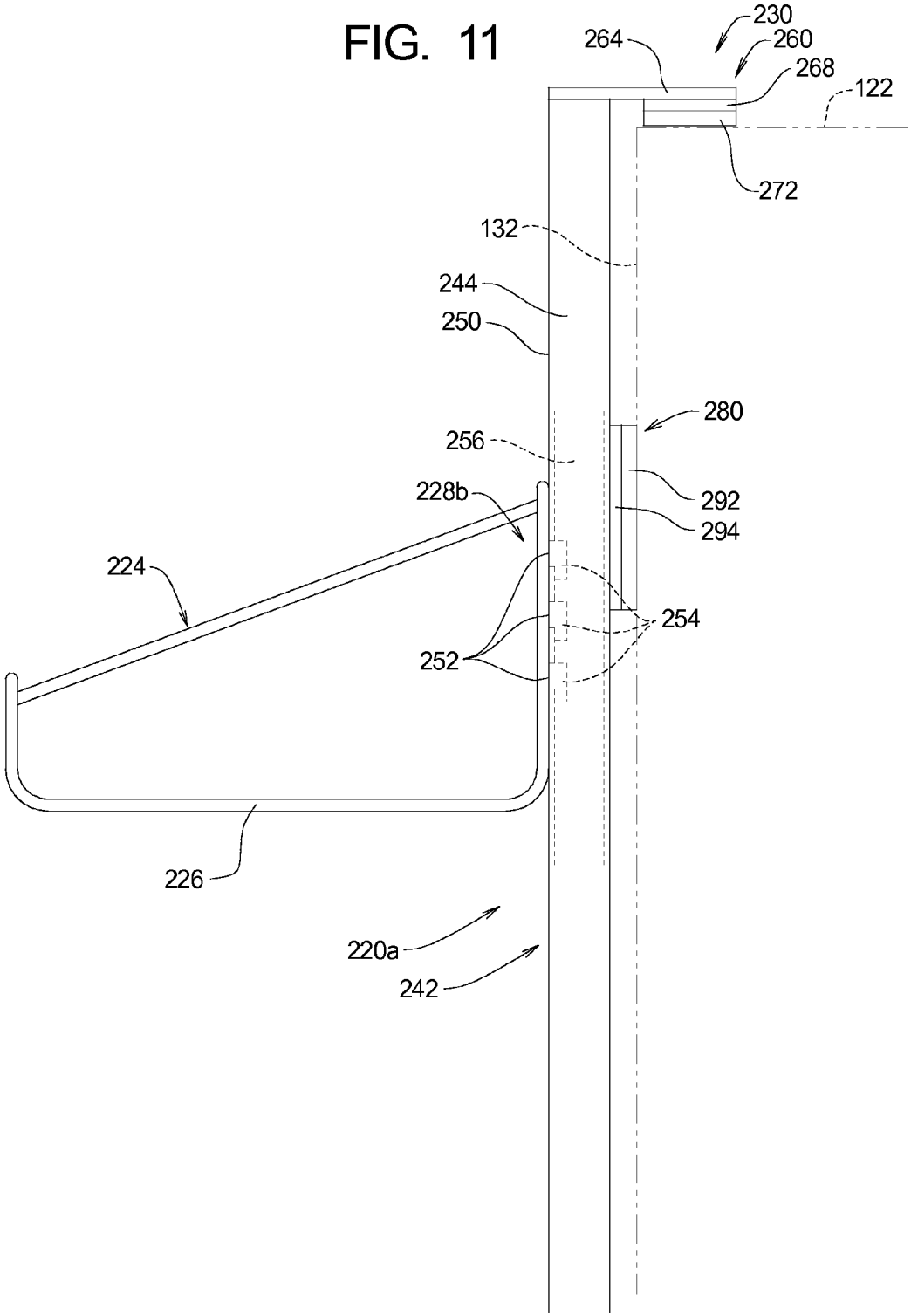
FIG. 11 is a is a side elevation view of the display system of FIG. 10.

Referring now to FIGS. 10 and 11 of the drawing, depicted therein is a variation 220*a* of the second embodiment of a display support system 220 described above. The display support system 220*a* is constructed and used in a manner that is similar to the display support system 220 as previously described. However, in addition to the upper magnetic portion 234, the display support system 220*a* comprises a lower magnetic portion 280 comprising a plurality of lower magnets 282 and lower mounting plates 284. The lower mounting plates 284 are rigidly connected to one or both of the vertical members 240 and 242 by welding, gluing, or the like.

The mounting plates 284 allow the lower magnets 282 to be secured relative to the vertical members 240 and 242 so that the magnets 282, when the display support system 220*a* is supported by the structure 122 as shown in FIGS. 10 and 11, engage the display surface 132 of the structure 122. As the display surface 132 is typically made of a magnetically attractable material such as metal, the magnets 282 magnetically secure positions of the vertical members 240 and 242 relative to structure 122.

Thus in addition to the magnetic attraction between the upper magnetic portion 234 and the upper surface 130, a magnetic attraction is formed between the magnetic portion 280 and the display surface 132. The combination of these magnetic attractions secures the display support system 220*a* relative to the structure 122. Gravitational loads on the display support system 220*a* are carried by the rear portion 230 as generally described above.

Figure 12:
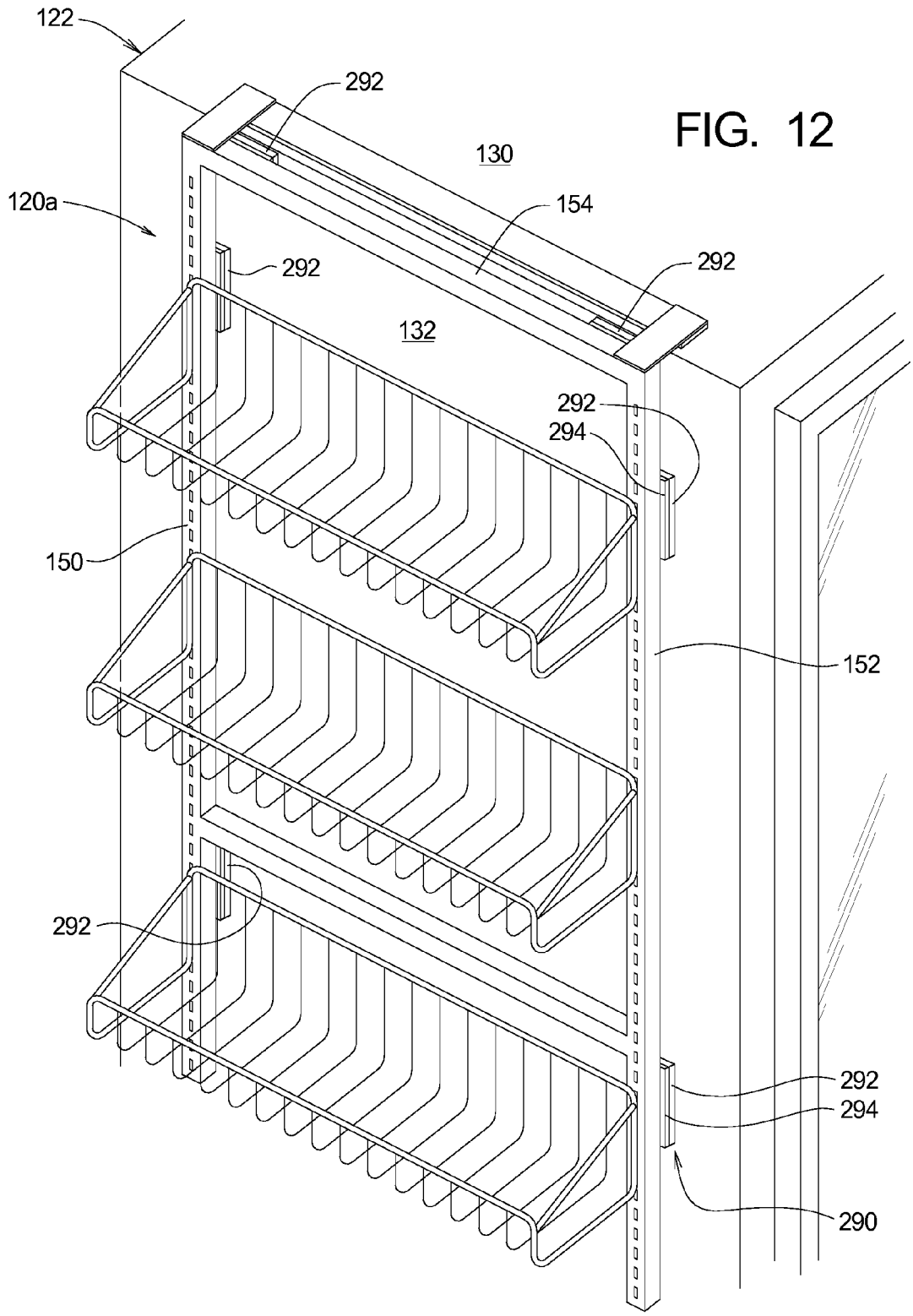
FIG. 12 is a perspective view depicting another example display support system of the present invention.
Figure 13:
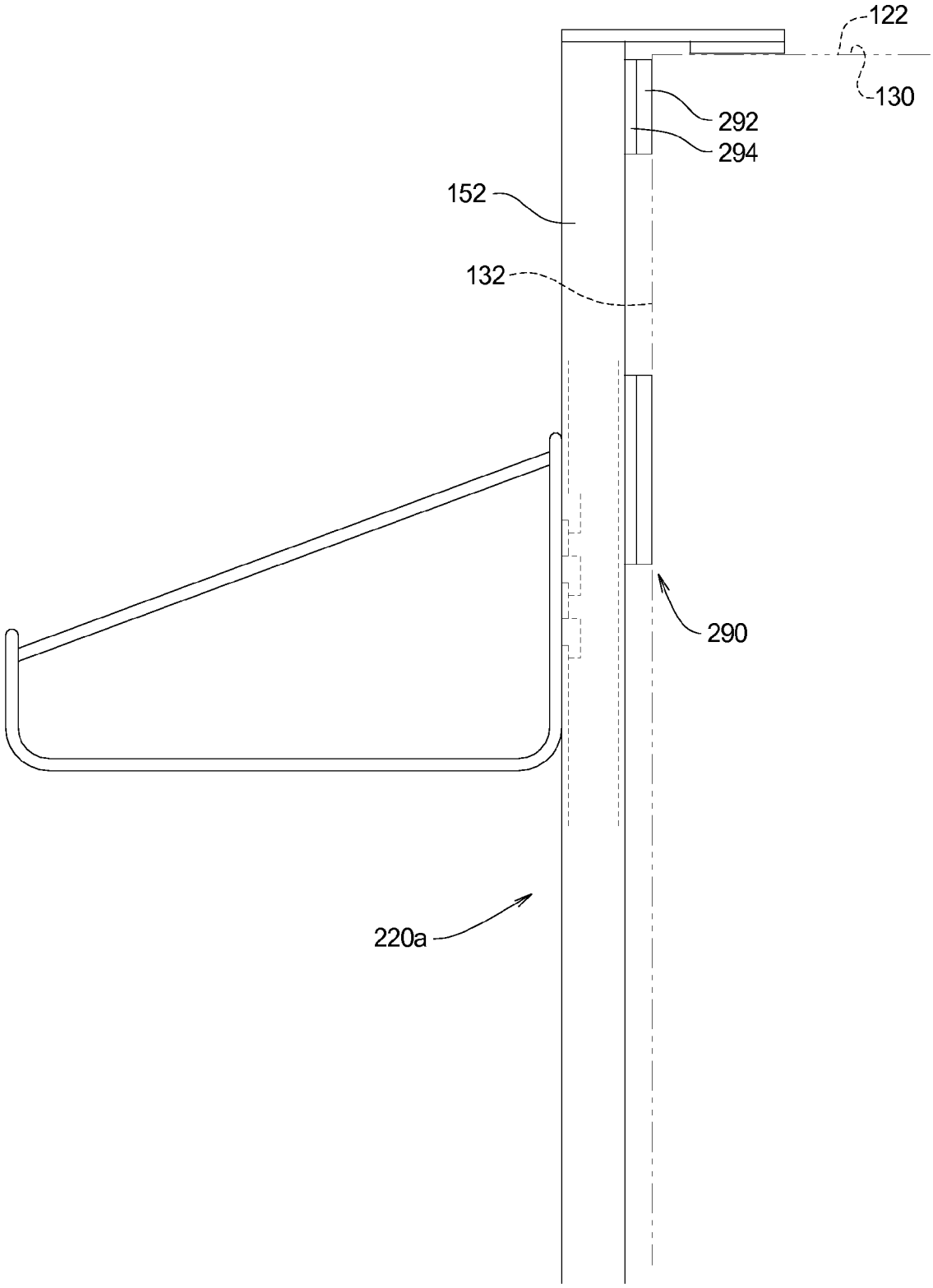
FIG. 13 is a side elevation view of the display system of FIG. 12.

Referring now to FIGS. 12 and 13, depicted therein is a variation 120*a* of the first embodiment of a display support system 120 described above. The display support system 120*a* is constructed and used in a manner that is similar to the display support system 120 as previously described. However, the example display support system 120*a* does not employ an upper magnetic portion 134, instead using only a lower magnetic portion 290 comprising a plurality of lower magnets 292 and lower mounting plates 294. The lower mounting plates 294 are rigidly connected to one or both of the vertical members 140 and 142 by welding, gluing, or the like.

The mounting plates 294 allow the lower magnets 292 to be secured relative to the vertical members 150 and 152 so that the magnets 292, when the display support system 120*a* is supported by the structure 122 as shown in FIGS. 10 and 11, engage the display surface 132 of the structure 122. As the display surface 132 is typically made of a magnetically attractable material such as metal, the magnets 292 magnetically secure positions of the vertical members 240 and 242 relative to structure 122.

Thus, instead of being magnetically attracted to the upper surface 130, a magnetic attraction is formed between the magnetic portion 290 and the display surface 132. The magnetic attraction between the magnetic portion 290 and the display surface 132 secures the display support system 120*a* relative to the structure 122. However, gravitational loads on the display support system 120*a* are still carried by the rear portion 140 as generally described above.

Figure 14:
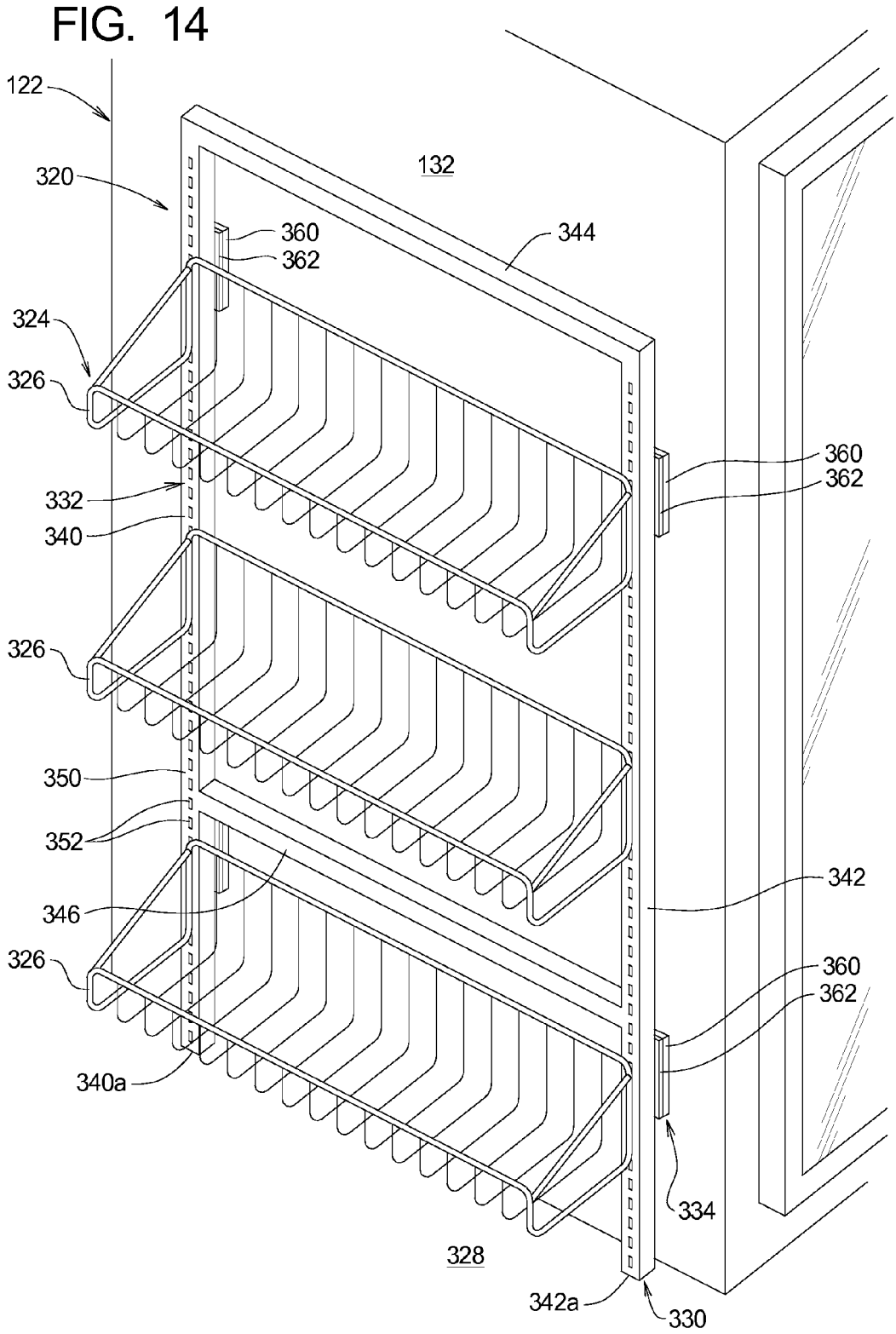
FIG. 14 is a perspective view depicting another example display support system of the present invention.

Referring now to FIG. 14, depicted therein is a yet another embodiment of a display support system 320 of the present invention. The example display support system 320 is depicted supporting accessories 324 in the form of a plurality of vertically spaced basket shelves 326 from the example metal structure 122 described above, with the metal structure 122 being supported by a floor surface 328. One or more items to be displayed may be placed on the shelves 326. The shelves 326 are or may be conventional and will be described herein only to the extent necessary for a complete understanding of the present invention.

The example display support system 320 comprises a bottom portion 330, a front portion 332, and a magnetic portion 334. The bottom portion 330 is adapted to rest on floor surface 328. The magnetic portion 334 magnetically engages the display surface 132 as will be described in further detail below. The front portion 332 is rigidly connected to or is integrally formed with the bottom portion 330 such that, when the bottom portion 330 engages the floor surface 328, the front portion 332 extends along at least a portion of the display surface 132.

A display support system constructed in accordance with the principles of the present invention can be made of a variety of materials and take on a number of configurations. In the example display support system 320, the front portion 332 comprises first and second vertical members 340 and 342 and upper and lower lateral members 344 and 346 formed of hollow metal tubes welded together in a generally rectangular configuration. Hollow metal tubes are readily available, lightweight, and durable, but the front portion 332 may be made from other materials such as plastic, wood, or the like.

As shown in FIG. 3, the hollow metal tubes that form the vertical members 340 and 342 define a front wall 350 in which a series of slots or openings 352 are formed. As is conventional and generally described above, the openings 352 allow tabs extending from the shelves 326 to extend through the openings 352 defined in the front walls 350 of the vertical members 340 and 342. The tabs engage the front wall 350 to secure the shelves 326 at desired vertical locations along the vertical members 340 and 342. The example shelves 326 are arranged at spaced vertical levels such that the shelves 326 are substantially level during normal use.

One of ordinary skill in the art will recognize that additional brackets may be used to support additional shelves. Alternatively, accessories 324 other than (or in addition to) brackets may be supported from the front portion 332 of the display support system 320.

The front portion of a display support system of the present invention can take many forms and need not take the form of the example front portion 332 described above. For example, in a simple configuration, the front portion 332 may comprise a single horizontal or vertical member adapted to engage one or more types of desired accessories 324. Alternatively, instead of discrete vertical and horizontal members, the front portion may comprise a sheet of material such as cardboard or plywood adapted to engage one or more types of desired accessories 324. Or instead of a rectangular arrangement of straight vertical and horizontal members, the front portion may be made of curved or angled members in a more fanciful shape.

The bottom portion of a display support system of the present invention may also take on a number of different forms depending upon the particular application. As perhaps best shown in FIG. 14, the example bottom portion 330 is formed by the bottom ends 340*a* and 342*a* of the vertical members 340 and 342. The vertical members 340 and 342 thus carry gravitational loads on the support system 320.

In the example display support system 320, the magnetic portion 334 comprises a plurality of magnetic members 360 that are secured to mounting plates 362. The example magnetic members 360 are in the form of flat magnetic sheets having dimensions that are approximately the same as the dimensions of the mounting plates 362. In the example support system 320, the magnetic members 360 are glued to the mounting plates 362. The nature, quantity, and configuration of the magnetic members 360 can take on a number of forms depending upon the precise nature of the display support system 320 and the accessories 324 to be suspended therefrom.

In addition, the magnetic members 360 can be secured to the mounting plates 362 by means other than adhesives. For example a shallow channel or socket may be formed in the mounting plates for the magnetic member or members. The magnetic members may also be embedded in or laminated to the mounting plates 362.

Figure 15:
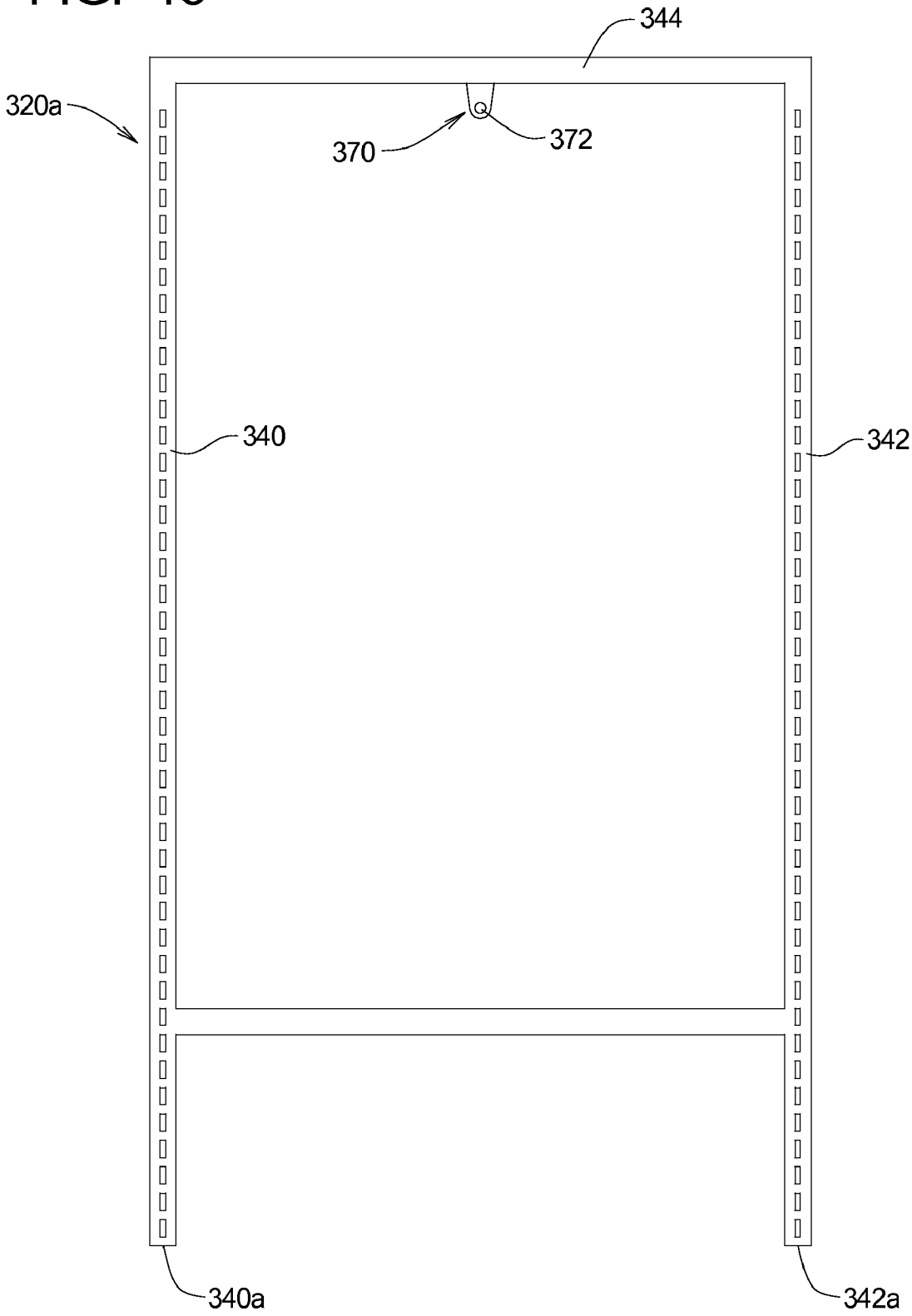
FIG. 15 is a front elevation view depicting another example display support system of the present invention.

Referring now to FIG. 15 of the drawing, depicted at 320*a* therein is a variation of the display support system 320 described above. The display support system 320*a* does not employ a magnetic portion 334; instead, a mounting flange 370 is rigidly connected to the upper lateral member 344. A mounting hole 372 is formed in the flange 370. A screw (not shown) or other fastening device may be passed through the hole 372 and into the display surface 132 to secure a position of the upper lateral member 344 relative to the device 122. However, gravitational loads are still carried by the lower ends 340*a* and 342*a* of the vertical members 340 and 342.

Figure 16:
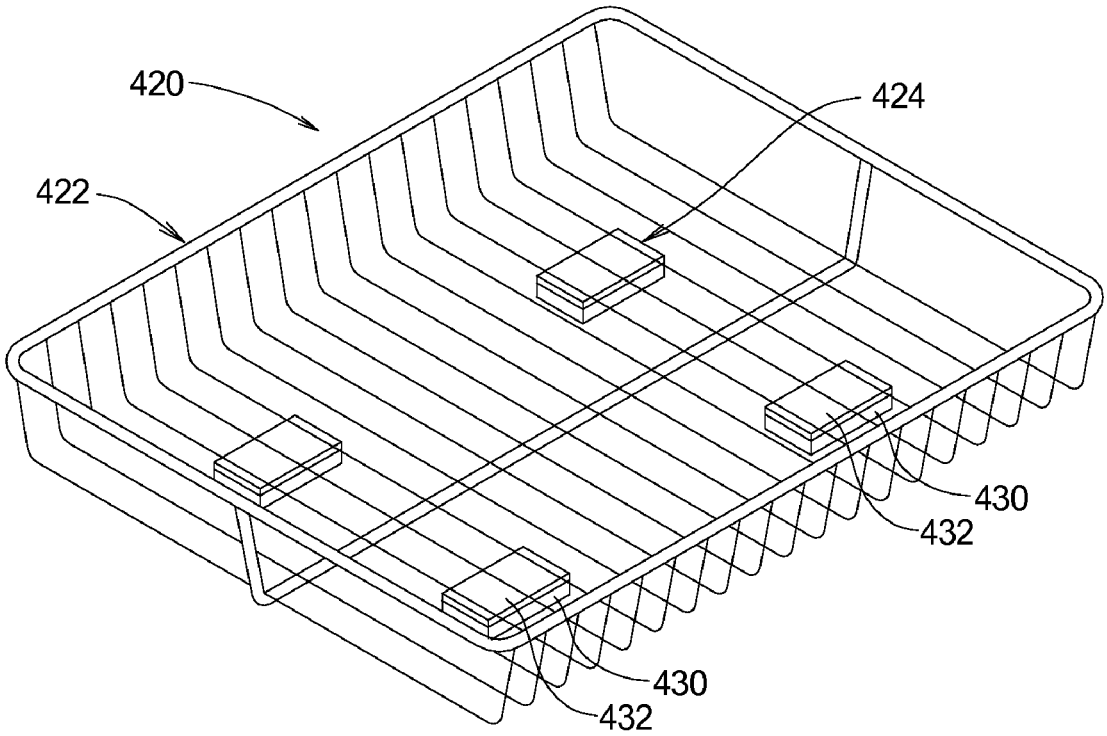
FIG. 16 is a perspective view of yet another example display support system of the present invention.

FIG. 16 of the drawing illustrates another example display support system 420 of the present invention. The display support system 420 takes the form of a basket portion 422 and a magnetic portion 424. The basket portion 422 is or may be conventional and is designed to hold and display a wide variety of products.

The magnetic portion 424 comprises a plurality of magnet members 430 and mounting plates 432. The mounting plates 432 are rigidly connected to the basket portion 422, and the magnet members 430 are rigidly connected to the mounting plates 432. The rigid connection between the mounting plates 432 and the basket portion 422 is formed by welding, but other connections may be used. The magnet members 430 are rigidly connected to the mounting plates 432 by gluing, lamination, or the like, but other connections may be used.

From the foregoing, it should be clear that the present invention may be embodied in forms other than those described above. The above-described systems are therefore to be considered in all respects illustrative and not restrictive, the scope of the invention being indicated by the appended claims rather than the foregoing description. All changes that come within the meaning and scope of the claims are intended to be embraced therein.

What is claimed is:

1. A display support system for supporting product for retail display from an appliance defining a magnetically attractable display surface, a door surface, a magnetically attractable upper surface, and an upper edge at a juncture of the display and upper surfaces and comprising a door arranged to allow access to an interior of the appliance through the door surface, the display support system comprising:

an accessory adapted to support the product for retail display;

a structure comprising a front portion adapted to support the accessory such that the accessory extends from the display surface of the appliance, and a rear portion rigidly connected to the front portion, where the rear portion is adapted to extend along and engage the upper surface of the appliance to bear downward loads on the front portion; and a rear magnetic portion adapted to magnetically secure the rear portion of the structure relative to the upper surface of appliance and inhibit movement of the front portion away from the display surface.

2. A display support system as recited in claim 1, in which the rear portion comprises at least one spacing member adapted to space the rear magnetic portion from the upper edge of the appliance.

3. A display support system as recited in claim 1, in which:

the front portion defines an upper lateral member; and the rear portion comprises at least one spacing member that extends from the upper lateral member to the rear magnetic portion and is adapted to space the rear magnetic portion from the upper edge of the appliance.

4. A display support system as recited in claim 1, in which:

the rear portion comprises at least one spacing member;

the rear magnetic portion comprises a rear mounting plate; and a rear magnetic member rigidly connected to the rear mounting plate; wherein the spacing member is rigidly connected to the front portion and the rear mounting plate and is adapted to space the rear magnetic member from the upper edge of the appliance.

5. A display support system as recited in claim 1, further comprising a front magnetic portion secured to the front portion such that the front magnetic portion is adapted to magnetically secure the front portion relative to the display surface of the appliance.

6. A display support system as recited in claim 5, in which:

the front magnetic portion comprises a front mounting plate; and a front magnetic member rigidly connected to the mounting plate; wherein the front mounting plate is rigidly connected to the front portion.

7. A method of supporting product for retail display comprising the steps of:

providing an appliance defining a magnetically attractable display surface, a door surface, a magnetically attractable upper surface, and an upper edge at a juncture of the display and upper surfaces and comprising a door arranged to allow access to an interior of the appliance through the door surface;

providing a structure defining a front portion and a rear portion, where the rear portion extends substantially perpendicularly to the front portion;

rigidly securing a magnetic portion to the structure;

arranging the structure relative to the appliance such that the rear portion extends along and engages the upper surface of the appliance such that the upper surface bears downward loads on the front portion; and the magnetic portion magnetically secures the structure to a desired location relative to the appliance, thereby inhibiting movement of the front portion away from the display surface;

providing an accessory;

supporting the accessory on the front portion such that the accessory extends from the display surface of the appliance; and support the product for retail display using the accessory.

8. A method as recited in claim 7, further comprising the step of securing the magnetic portion to the rear portion such that the magnetic portion magnetically secures the rear portion relative to the upper surface of the appliance.

9. A method as recited in claim 7, further comprising the step of securing the magnetic portion to the front portion such that the magnetic portion magnetically secures the front portion relative to the display surface of the appliance.

10. A method as recited in claim 7, in which the step of rigidly securing the magnetic portion to the structure comprises the steps of:

rigidly connecting a first magnetic portion to the rear portion such that the first magnetic portion magnetically secures the rear portion relative to the upper surface of the appliance; and rigidly connecting a second magnetic portion to the front portion such that the second magnetic portion magnetically secures the front portion relative to the display surface of the appliance.

11. A display support system for supporting product for retail display from an appliance defining a magnetically attractable display surface, a door surface, a magnetically attractable upper surface, and an upper edge at the juncture of the display and upper surfaces and comprising a door arranged to allow access to an interior of the appliance through the door surface, the display support system comprising:

an accessory adapted to support the product for retail display;

a structure comprising a front portion adapted to support the accessory such that the accessory is adapted to extend from the display surface of the appliance, and a rear portion rigidly connected to the front portion, where the rear portion is adapted to extend along and engage the upper surface of the appliance to bear downward loads on the front portion; and a first magnetic portion rigidly secured to the rear portion of the structure; and a second magnetic portion rigidly secured to the front portion of the structure; whereby the first and second magnetic portions are adapted to secure the structure relative to the appliance and thereby inhibit movement of the front portion away from the display surface.

12. A display support system as recited in claim 11, in which the rear portion comprises at least one spacing member adapted to space the first magnetic portion from the upper edge of the appliance.

13. A display support system as recited in claim 11, in which:

the front portion defines an upper lateral member; and the rear portion comprises at least one spacing member that extends from the upper lateral member to the first magnetic portion and are thus adapted to space the first magnetic portion from the upper edge of the appliance.

14. A display support system as recited in claim 13, in which:

the rear portion comprises at least one spacing member;

the first magnetic portion comprises a mounting plate; and a magnetic member rigidly connected to the mounting plate; wherein the spacing member is rigidly connected to the front portion and the mounting member and are thus adapted to space the magnetic member from the upper edge of the appliance.

15. A display support system as recited in claim 11, in which:

the second magnetic portion comprises a mounting plate; and a magnetic member rigidly connected to the mounting plate; wherein the mounting plate is rigidly connected to the front portion.

16. A display support system as recited in claim 11, in which:

the first magnetic portion comprises a first mounting plate rigidly connected to the rear portion; and a first magnetic member rigidly connected to the mounting plate; and the second magnetic portion comprises a second mounting plate rigidly connected to the front portion; and a second magnetic member rigidly connected to the mounting plate.

17. A combination of:

an appliance defining a magnetically attractable display surface, a door surface, a magnetically attractable upper surface, and an upper edge at a juncture of the display and upper surfaces and comprising a door arranged to allow access to an interior of the appliance through the door surface, and a display support system for supporting product for retail display from the appliance comprising an accessory adapted to support the product for retail display;

a structure comprising a front portion adapted to support the accessory such that the accessory extends from the display surface of the appliance, and a rear portion rigidly connected to the front portion, where the rear portion is adapted to extend along and engage the upper surface of the appliance to bear downward loads on the front portion; and a front magnetic portion adapted to magnetically secure the front portion of the structure relative to the display surface of appliance and inhibit movement of the front portion away from the display surface.

18. A display support system as recited in claim 17, further comprising a rear magnetic portion secured to the rear portion such that the rear magnetic portion is adapted to magnetically secure the rear portion relative to the upper surface of the appliance.

19. A display support system as recited in claim 18, in which:

the rear magnetic portion comprises a rear mounting plate; and a rear magnetic member rigidly connected to the mounting plate; wherein the rear mounting plate is rigidly connected to the rear portion.

* * * * *